343-872

8/19/80 XR 4,218,684 SR

United States Patent [19]

Northcutt

[11] 4,218,684

[45] Aug. 19, 1980

[54] SECURITY COVER FOR TRUNK AND ROOF MOUNTED ANTENNAE

[76] Inventor: William Northcutt, 1001 Alcazar, NE., Albuquerque, N. Mex. 87110

[21] Appl. No.: 38,875

[22] Filed: May 14, 1979

[51] Int. Cl.[2] ..... H01Q 1/42
[52] U.S. Cl. ..... 343/715; 343/872
[58] Field of Search ..... 343/715, 872, 900, 720

[56] References Cited

U.S. PATENT DOCUMENTS 4,087,819 5/1978 Dalrymple ..... 343/715
4,134,121 1/1979 Northcutt ..... 343/715

*Primary Examiner*—Eli Lieberman
*Attorney, Agent, or Firm*—Walter R. Keller

[57] ABSTRACT

A security cover consisting of a base pad, base cover, top cover, steel washer, and snap ring, for use on auto or truck mounted antennae.

4 Claims, 1 Drawing Figure

SECURITY COVER FOR TRUNK AND ROOF MOUNTED ANTENNAE

BACKGROUND

1. Field of the Invention

This invention relates primarily with automobile trunk mounted radio antenna, and roof mounted radio antennae for automobiles and trucks. The device is particularly designed to be used in association with a clip mounted antenna which is secured to the trunk lid of an automobile, or to antenna bolted to and through a roof of an automobile or truck. The invention secures the antenna and its base to the vehicle. A secondary function is covering and protecting the antenna mount and base from dust, dirt and the elements.

2. Description of Prior Art

In recent years automobile radios, and in particular CB's have become increasingly popular, and the installation of roof mounted or trunk mounted antenna on vehicles is common place. However, theft of the antenna has become such a problem for the owners that it has become almost standard practice to remove the antennae and secure it inside the trunk of the vehicle whenever the vehicle is left unattended. NORTHCUTT, U.S. Pat. No. 4,134,121 discloses a security cover for antennae which provides security against theft of the antennae. However, NORTHCUTT, U.S. Pat. No. 4,134,121 must have its own base plate attached to the vehicle, and in the roof mounting mode, requires complete removal of the antennae, and and antenna body and base to install, and is not adaptable to cone shaped whip mounts.

SUMMARY OF THE INVENTION

The devise of this invention is primarily designed to be constructed of injection-mold plastic components. A wide variety of molding techniques are acceptable as well as various plastic materials. The devise of this invention comprises a base pad, base cover, top cover, washer, snap ring, and resilient bushing. The washer and snap ring are constructed of metal, while cover and top cover are constructed of injection-mold plastic. The base pad and resilient bushing are constructed of any resilient material such as rubber. The washer and snap ring secure the invention to the antennae, not the vehicle, and the invention secures the antennae and the antennae mount to the vehicle by precluding access from without the vehicle. The invention provides a base mounting pad to minimize noise of rattling and to protect the finish of the vehicle. It is the object of the invention to provide a security cover for antennae mounted on vehicles, particularly trunk or roof mounted, which is economical and easy to install and which can be adapted to conical or cylindrical antenna body.

DESCRIPTION OF THE PREFERRED EMBODIMENT

Figure 1:
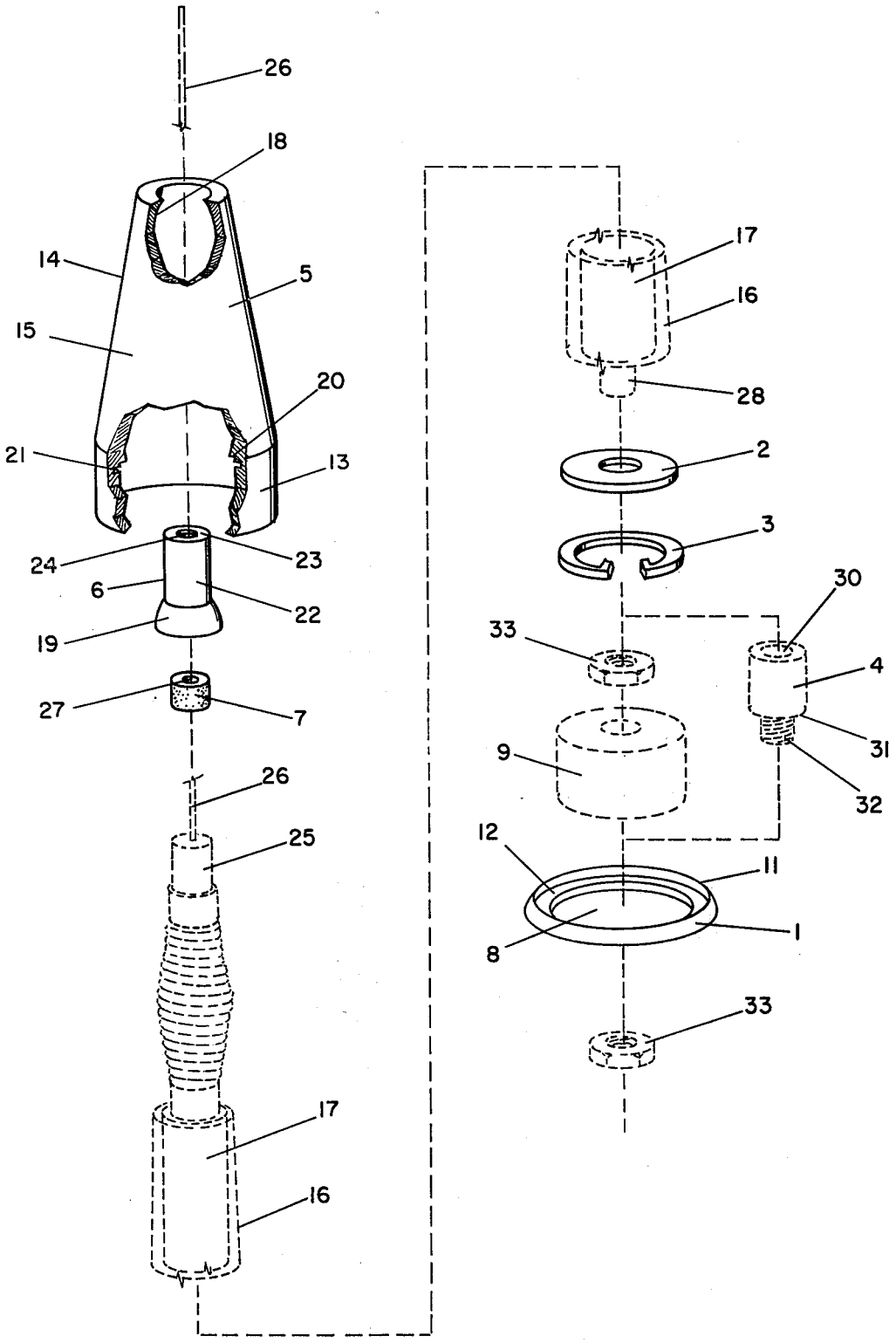
FIG. 1 is an exploded isometric view of the invention.

FIG. 1 shows the invention to consist of a base pad 1, a washer 2, a snap ring 3, an adapting stud 4, a base cover 5, a top cover 6, and a resilient bushing 7. The base pad 1 is made of resilient material such as rubber or plastic and is shaped as a circular ring having a center hole 8 of sufficient diameter to allow the base pad 1 to be easily slid down over an antennae base 9. The base pad 1 has a flat bottom 10, and an upper surface 11 having a lip 12. The base cover 5 is shown in FIG. 1 to have a bottom cylindrical section 13, a truncated conical section 14, and a top swivel section 15, all integrally formed. The bottom cylindrical section has an internal diameter sufficiently large to easily slide over the antenna base 9, and is sized to mateably fit inside the lip 12 of the base pad 1. The heighth of the bottom cylindrical section 13 is approximately sufficient so that when the base cover 5 is mated to the base pad 1 as installed on a vehicle, the juncture of the bottom cylindrical section 13 and the truncated conical section 14 is at the same height as the top of the antenna base 9. The truncated conical section 14 at its largest outside diameter is integrally formed with and has the same diameter as cylindrical section 13. The truncated conical section 14 also being hollow has an inside taper which leaves sufficient space to accomodate either a conical antenna body 16 or a cylindrical antena body 17. FIG. 1 shows the outside configuration of conical antenna body 16 and also the outside configuration of the cylindrical body 17 which are commonly commercially available. The swivel section 15 of the base cover 5 is the top portion of the truncated conical section 14 and is integrally formed therewith. The swivel section 15 has a concave, approximately spherical, inner surface 18, which mates with a convex, approximately spherical, shoulder 19 on the top cover 6. The base cover 5 at the juncture of the truncated conical section 14 and the cylindrical section 13 has a right angle shoulder 20 formed by making the inner diameter of the truncated conical secton 14 smaller than the inner diameter of the cylindrical section 13. It is against this right angle shoulder 20 that the washer 2 bears. Adjacent to the right angle shoulder 20 and circumferentially around the inner surface of the cylindrical section 13, there is a rectangular groove 21 into which the snap ring 3 expands.

The top cover 6 is generally a hollow member having a cylindrical side 22, a top 23 with an antenna port 24, and the convex shoulder 19, all integrally formed. The inner diameter of the cylindrical side 22 is sufficient to accept a whip mount 25, and the antenna port has a circular hole, of sufficient diameter to allow passage and insertion of the whip 26. At the open end, and on the outside surface of the cylindrical side 22, the top cover 6 has the convex shoulder 19 generally spherical in shape which slideably mates with the inner spherical surface 18 of the base cover 5.

The resilient bushing 7 is cylindrical in shape having an outside diameter somewhat smaller than the inside diameter of the top cover 6. The resilient bushing 7 has a cylindrical center bore 27 which has a diameter the same or larger than the diameter of the antenna port 24. The height of the resilient bushing 7 is such that when the invention is installed over an antenna, the resilient bushing 7 is compressed between the top cover 6 and the top of the whip mount 25. A coil helical spring is considered to be a resilient bushing 7.

The washer 2 is a standard metal flat washer whose outside diameter is sized to mateably insert into the inside of the cylindrical section 13 and bear against the right angle shoulder 20.

The snap ring 3 is a standard metal expanding member sized to compress to the diameter of the inner surface of the cylindrical section 13 and to expand into the rectangular groove 21.

To install the invention the conical antenna body 16 or the cylindrical antenna body 17, whichever is used in the antenna, is unbolted from the antenna base 9. The snap ring 3, then the washer 2 are placed on the antenna base 9 and the antenna body 16, or 17, is re-installed and secured to the antenna base. The resilient bushing 7 is slid down over the whip 26 to the top of the whip mount 25. The base pad 1 is placed around the antenna base 9, flat bottom 10 against the vehicle. The top cover 6 is inserted into the base cover 5 by inserting the top 23 first into the cylindrical section 13 and sliding the top cover 6 through and out the small end of the truncated conical section 14 so that the convex shoulder 19 mates with the inner spherical surface 18. The base cover 5 is then installed over the antenna by inserting the whip 26 into the cylindrical section 13 through antenna port 24, and pushing the base cover 5 down over the washer 2 and the snap ring 3 until the snap ring 3 engages the rectangular groove 21 and the washer 2 bears against the rectangular shoulder 20. This assembly will compress the resilient bushing 7 thereby holding the top cover 6 in position.

In some installations particularly roof mounted antennae, the antennae base 9 may not be used, or the antennae body 16 or 17 may be bolted directly to the roof of the vehicle by means of a threaded stud 28 which is integral to the antenna body 16 or 17. If this situation obtains, it will be necessary to use an adapting stud 4. The adapting stud 4 made of metal, such as brass, has a threaded female end 30 which mateably screws on to the stud 28, a bearing surface 31 which bears on the roof of the vehicle and a threaded male end 32 which mateably accepts a nut 33. The installation of the adapting stud 4 provides the space and heighth required because the antenna base 9 was not used.

I claim:

1. A security cover for an antenna mounted on an automobile comprising:

a. a base pad constructed of resilient material;

b. a base cover which has a cylindrical section, and a truncated conical section and a swivel section all integrally formed, and a rectangular shoulder at the juncture of the cylindrical section and truncated conical section and a rectangular groove, adjacent to the rectangular shoulder, circumferentially around inside surface of the cylindrical section, and said base cover having a concave, generally spherical surface on the inner side of the swivel section;

c. a top cover which has a cylindrical side, a top, an antenna port, and a convex shoulder all integrally formed wherein the antenna port is a circular hole in the top sized to accept an antenna whip and the convex shoulder is adjacent to the open end of the cylindrical side and the convex shoulder is on the outside of the cylindrical side, the convex shoulder being sized and shaped to slideably mate with the generally spherical surface on the inner side of the swivel section of the base cover;

d. a resilient bushing, made of resilient material, generally cylindrical in shape with a center bore of sufficient diameter to accept and allow an antenna whip to pass through;

e. a metal washer having a center hold of sufficient outside diameter to permit the washer to be slideably inserted into the cylindrical section and bear against the rectangular shoulder;

f. a snap ring sized to slideably be inserted into the cylindrical section of the base cover when compressed and to mateably insert into the rectangular groove when allowed to expand, yet after inserting into the rectangular groove the snap ring bears against the washer;

g. an adapting stud with a female end threaded to mateably connect with a mounting stud on an antenna body, and said adapting stud having a male end threaded to accept a nut and a bearing surface to bear on a vehicle surface.

2. The invention of claim 1 wherein the base cover and top cover are made of hard plastic.

3. The invention of claim 1 wherein the snap ring, washer, and adapting nut are made of metal.

4. The invention of claim 1 wherein the resilient bushing is a coil helical spring.

* * * * *